US006237191B1

(12) United States Patent
Ferrari et al.

(10) Patent No.: US 6,237,191 B1
(45) Date of Patent: May 29, 2001

(54) HINGE OF THE SOFT TYPE WITH BRAKED OPEN POSITION

(75) Inventors: Franco Ferrari, Località Deviscio, 2, 23900 Lecco (IT); Carlo Migli, Lecco (IT)

(73) Assignee: Franco Ferrari (IT)

( * ) Notice: Subject to any disclaimer, the term of this patent is extended or adjusted under 35 U.S.C. 154(b) by 0 days.

(21) Appl. No.: 09/455,393

(22) Filed: Dec. 6, 1999

(30) Foreign Application Priority Data

Dec. 18, 1998 (IT) ..... MI98U0810

(51) Int. Cl.[7] ..... E05D 11/10; E05F 1/08

(52) U.S. Cl. ..... 16/335; 16/371; 16/374; 16/297; 16/286

(58) Field of Search ..... 16/335, 336, 337, 16/371, 374, 297, 286, 287, 288, 296

(56) References Cited

U.S. PATENT DOCUMENTS 1,390,579 * 9/1921 Norquist ..... 16/374
4,449,269 * 5/1984 Sunderneier ..... 16/333
4,502,182 * 3/1985 Lautenschlager et al. ..... 16/288
4,716,622 * 1/1988 DeBruyn ..... 16/297
5,027,474 * 7/1991 Bowers ..... 16/297
5,029,362 * 7/1991 Prodan ..... 16/288
5,655,261 * 8/1997 Cress ..... 16/286

* cited by examiner

*Primary Examiner*—Chuck Y. Mah
(74) *Attorney, Agent, or Firm*—Shlesinger, Fitzsimmons & Shlesinger

(57) ABSTRACT

A hinge for furniture comprises a bowl (11) and a wing (12) interconnected by connecting rods (13, 14) pivotally mounted to enable a movement between a closed position and an open position of the hinge. An automatic closure mechanism (19, 20) urges the hinge towards a closed position when the hinge is brought close to such a closed position. The bowl (11) comprises regions (21) of interference with at least one connecting rod when the hinge is close to the open position, to offer an increased resistance to said movement over a length thereof close to the open position.

4 Claims, 1 Drawing Sheet

HINGE OF THE SOFT TYPE WITH BRAKED OPEN POSITION

BACKGROUND OF THE INVENTION

The present invention relates to an improved hinge for furniture with a spring closure.

Generally the most appreciated and employed spring closure mechanisms for furniture hinges are those enabling a so-called soft closure. These mechanisms are designed in such a manner that an intervention only takes place at the last closure degrees, leaving the door free at all other possible positions thereof, until its maximum opening allowed by the mechanical linkage.

Different systems for accomplishing mechanical linkages for closures having the above described features are known, but they all have a problem in common which is implicit in the definition itself of "soft closure": since the spring does not work in the maximum-opening position, in this position the hinge arm or wing is idle, and this will make it difficult to mount the door to the piece of furniture, on fitting of the wing in its base which has been already fastened to the piece of furniture itself. In fact, during mounting of the door, the wing (which must stay close to the maximum-opening position in order to be fitted in the base) may accidentally touch the piece of furniture side and rotate to a position making mounting impossible.

Usually hinges have circular drawn or gauged shapes around the hole for pivotal mounting of the upper connecting rod to the bowl. These drawn shapes mainly aim at eliminating side clearances resulting from coupling between the connecting rod and bowl. However increase of the interference produced by these drawn shapes in order to offer a sufficient braking action to the wing rotation is impossible, because the hinge would be too much blocked in its closure position too, causing a loss of force in the spring mechanism and in its free movement between the open and closed positions.

It is a general aim of the present invention to obviate the above mentioned drawbacks, by providing a hinge with a soft mechanism offering an easier mounting.

SUMMARY OF THE INVENTION

In view of this aim, in accordance with the invention, a hinge for furniture has been conceived which comprises a bowl and a wing connected to each other by connecting rods pivotally mounted to enable a movement between a closed position and an open position of the hinge, an automatic closure mechanism urging the hinge to the closed position when said hinge is brought close to such a closed position, characterised in that the bowl comprises regions of interference with at least one connecting rod when the hinge is close to the open position to offer an increased resistance to said movement over a length thereof close to the open position.

BRIEF DESCRIPTION OF THE DRAWINGS

For better explaining the innovatory principles of the present invention and the advantages it offers over the known art, a possible embodiment applying these principles will be described hereinafter, by way of non-limiting example, with the aid of the accompanying drawings. In the drawings.

DETAILED DESCRIPTION OF THE INVENTION

Figure 1:
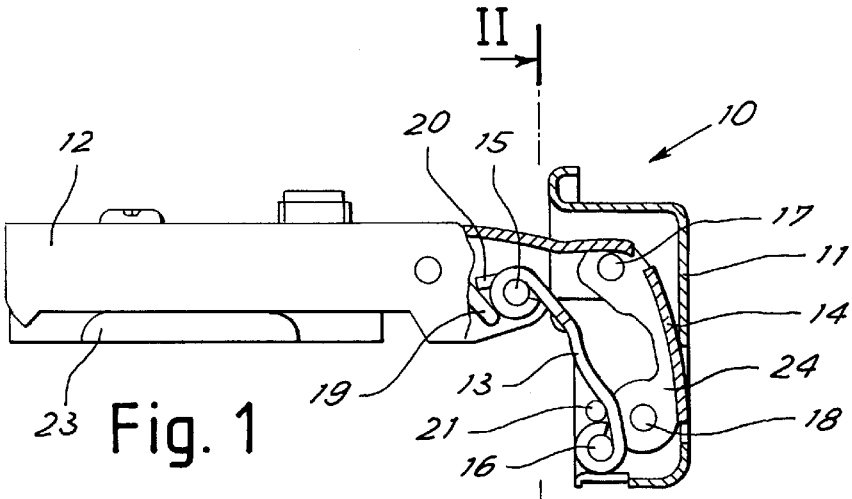
FIG. 1 is an elevation side view, partly in section, of a hinge in its closed position, made in accordance with the invention.
Figure 2:
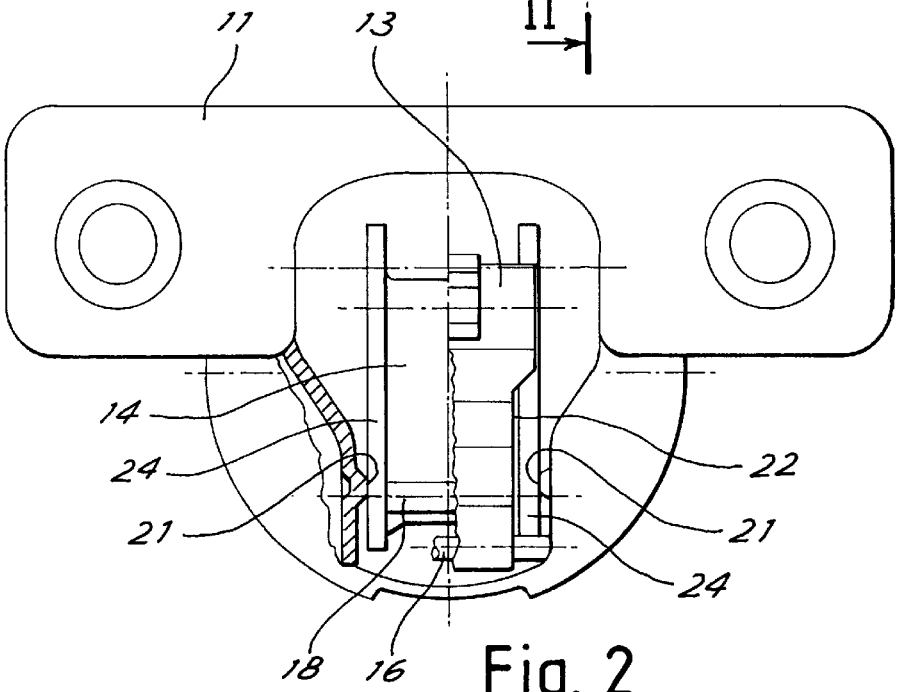
FIG. 2 is a partial view of the hinge, sectioned along line II—II in FIG. 1.
Figure 3:
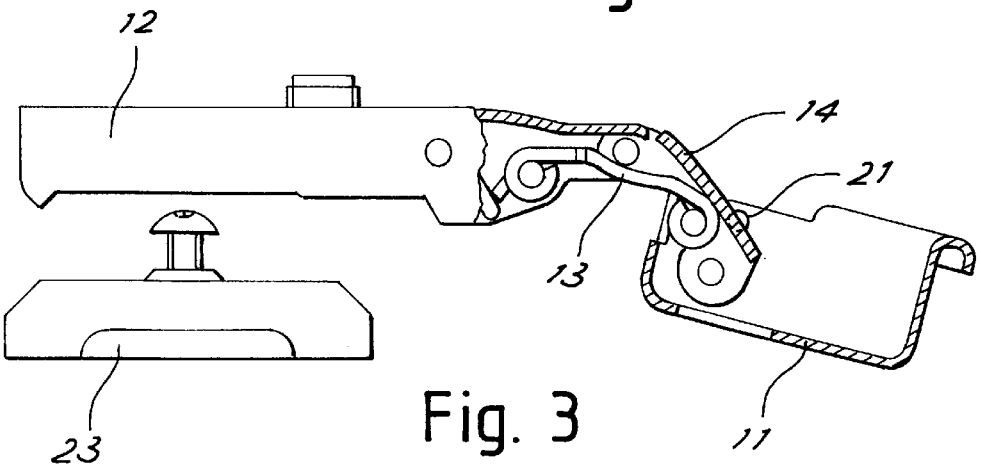
FIG. 3 is an exploded view, similar to the view in FIG. 1, but with the hinge in an open position.

With reference to the drawings, a hinge generally identified by 10, comprises a bowl 11 and a wing 12, interconnected by a lower connecting rod 13 and an upper connecting rod 14 pivotally mounted by means of pivot pins 15, 16 and 17, 18 respectively, to provide a mechanical linkage for movement of the bowl relative to the wing, between a closed position (shown in FIG. 1) and an open position (shown in FIG. 3). The so-called "upper" connecting rod is the outermost connecting rod relative to the bowl when the hinge is in its open position.

A spring closure mechanism acts on the mechanical linkage to supply a thrust action towards the closed position in the last part of the closure movement.

This mechanism may be of any known type. In the embodiment shown, it may comprise a spring 19 acting on a cam surface 20 of the lower connecting rod which is the outermost connecting rod relative to the bowl when the hinge is in its closed position.

The wing is intended for being fastened, by known "bayonet" or "slide-on" coupling systems, to a base 23. In accordance with the invention, the bowl is comprised of two gauged regions or regions of interference with the upper connecting rod, made in the form ridges or projections 21 in the side wall of the bowl holding the pivot pin 18 seating and spaced apart from said seating. These ridges can advantageously be obtained by drawing. As can be seen from a comparison between FIGS. 1 and 3, the interference regions are conveniently positioned for interfering with the upper connecting rod only when the hinge is close to, or at its completely open position. In other words, a small arc in the hinge movement occurs until complete opening, in which arc projections 21 interfere with the side walls of the upper connecting rod offering an increased resistance to movement. The hinge keeps its normal operation in the rest of its opening-closing stroke. The lower connecting rod 13 is provided with tapering portions 22 preventing it from interfering with projections 21. Interference of the projections with the upper connecting rod advantageously takes place at side walls 24 of the upper connecting rod. At this point it is apparent that the intended purposes have been achieved.

By adopting the proposed solution the upper connecting rod does not interfere with regions 21 at the closed position, thereby avoiding any reduction in the force of the automatic closure mechanism. In addition, by arranging the gauged regions at an appropriate distance from the rotation centre 18 of the upper connecting rod, a greatly higher friction torque is achieved, the interference being the same, as compared with the torque that would be achieved with gauged regions around the pivot pin, for example.

When in use, the hinge in accordance with the invention also has the advantage of having a slightly braked open position.

Obviously, the above description of an embodiment applying the innovatory principles of the present invention is given by way of example only and therefore must not be considered as a limitation of the scope of the invention as herein claimed. For instance, the hinge shape and attachment between the wing and base can be different from those shown, and also different may be the soft-closure mechanism.

What is claimed is:

1. A hinge for furniture comprising a bowl and a wing connected to each other by connecting rods pivotally mounted to enable a movement between a closed position and an open position of the hinge, an automatic closure mechanism urging the hinge to the closed position when said hinge is brought close to such a closed position, characterised in that the bowl comprises regions of interference for interfering with at least one connecting rod when the hinge is close to the open position, to offer an increased resistance to said movement over a length thereof close to the open position.

2. A hinge as claimed in claim 1, wherein the interference regions are formed with ridges made in the side wall of the bowl at a point spaced apart from a pivot pin for pivotal mounting of the at least one connecting rod to the bowl, and acting on side walls of this connecting rod.

3. A hinge as claimed in claim 1, wherein the at least one connecting rod is the outermost connecting rod relative to the bowl, when the hinge is in the open position.

4. A hinge as claimed in claim 1, wherein the connecting rods are two in number, the closure mechanism acting on the outermost connecting rod relative to the bowl, when the hinge is in the closed position.

* * * * *